United States Patent [19]

Zahradnik et al.

[11] Patent Number: 4,474,249

[45] Date of Patent: Oct. 2, 1984

[54] KELLY SEAL

[75] Inventors: Anton F. Zahradnik, Sugarland; John W. Stevens, Corsicana, both of Tex.

[73] Assignee: Hughes Tool Company, Houston, Tex.

[21] Appl. No.: 426,437

[22] Filed: Sep. 29, 1982

[51] Int. Cl.[3] ..... E21B 3/00

[52] U.S. Cl. ..... 173/163; 173/171

[58] Field of Search ..... 173/163–167, 173/171; 175/195; 166/84; 277/31; 403/408, 337; 83/699

[56] References Cited

U.S. PATENT DOCUMENTS

| | | | |
|---|---|---|---|
| 2,126,007 | 8/1938 | Guiberson | 277/31 |
| 2,415,572 | 2/1947 | Jaques | 255/19 |
| 2,915,152 | 12/1959 | Graham | 403/408 |
| 3,346,286 | 10/1967 | Wescott | 403/408 |
| 3,367,427 | 2/1968 | Baumgardner | 173/22 |
| 3,416,823 | 12/1968 | Auer | 403/408 |
| 3,513,665 | 5/1970 | Crickmer | 175/195 |
| 3,525,404 | 8/1970 | Newman | 173/150 |
| 3,976,130 | 8/1976 | Chambless | 166/84 |
| 4,058,023 | 11/1977 | Smith | 403/337 |
| 4,261,251 | 4/1981 | Shepard | 173/150 |
| 4,312,404 | 1/1982 | Morrow | 166/84 |
| 4,326,584 | 4/1982 | Watkins | 166/84 |
| 4,327,804 | 5/1982 | Reed | 166/84 |
| 4,345,766 | 8/1982 | Turanyi | 166/84 |

*Primary Examiner*—James M. Meister
*Assistant Examiner*—J. L. Knoble
*Attorney, Agent, or Firm*—Robert A. Felsman; Charles D. Gunter, Jr.

[57] ABSTRACT

An earth boring machine is shown with an improved kelly seal. The machine includes a hydraulic cylinder and a kelly rotatably carried within the cylinder and axially movable with respect to the longitudinal axis of the cylinder. A rotary quill surrounds the kelly for supplying rotational force to the kelly. A packing assembly carried about the kelly within the hydraulic cylinder proximate and end thereof seals hydraulic fluid within the hydraulic cylinder. An improved retaining assembly connects the packing assembly to the rotary quill but allows limited relative rotational movement of the packing assembly with respect to the rotary quill about the longitudinal axis of the kelly. The limited movement provided by the retainer assembly isolates the packing assembly from drive torque which is transferred from the rotary quill to the kelly, thereby reducing the tendency of the packing assembly to drive the kelly.

8 Claims, 2 Drawing Figures

KELLY SEAL

BACKGROUND OF THE INVENTION

1. Field of the Invention

This invention relates in general to earth boring machines and in particular to an improved kelly seal for a hydraulic mast digger type earth boring machine.

2. Description of the Prior Art

Hydraulically powered boring machines known as "diggers" are presently used in the construction industries for drilling shallow holes, as for foundation piers. The digger is usually mounted on a truck and includes a hydraulic mast or cylinder twenty feet or more in length. A square bar known as a kelly is rotatably carried in the hydraulic cylinder and is rotatably driven by a hydraulic or gear driven rotary assembly through a drive bushing. The kelly has a head at its top which serves as a piston to move the kelly up and down in response to hydraulic fluid pressure in the hydraulic cylinder. A cutting tool, usually an auger, is secured to the bottom of the kelly for digging a hole.

The kelly head normally includes a set of bearings which are secured to the top of the kelly and mounted in a bearing sleeve. The bearing sleeve moves longitudinally in the hydraulic cylinder and the bearings allow the kelly to rotate with respect to the bearing sleeve. A cap, sometimes called a spindle, is secured to the top of the sleeve. The cap and bearing sleeve form a piston for movement in the cylinder in response to hydraulic fluid pressure.

The kelly is sealed at the bottom of the hydraulic cylinder by a packing assembly. The kelly seal at the bottom of the cylinder is subjected to high pressures and varying degrees of torque because the kelly may be rotating while it is being raised or lowered within the hydraulic cylinder. It is essential that the kelly seal at the lower end of the hydraulic cylinder be effective and long lasting in order to minimize fluid loss from within the hydraulic cylinder since the fluid serves to lubricate the kelly drive surfaces and provides the source of "crowd" or hoisting power for the kelly.

In one prior design, the packing assembly was rigidly affixed to a drive bushing located between the kelly and the rotary assembly of the device. As the drive bushing became worn with time, a certain amount of play developed between the drive bushing and kelly. The packing assembly surrounding the lower end of the kelly and rigidly affixed to the drive bushing became a point of torque transmission between the rotary assembly, drive bushing, and kelly. As a result, the packing was distorted due to the torque load and began to deteriorate causing a loss of hydraulic fluid.

SUMMARY OF THE INVENTION

The earth boring machine of the invention has a hydraulic cylinder and a kelly rotatably carried within the cylinder and axially movable with respect to the longitudinal axis of the cylinder. A rotary quill surrounds the kelly for supplying rotational force to the kelly. A packing assembly is carried about the kelly within the hydraulic cylinder proximate an end thereof for sealing hydraulic fluid within the hydraulic cylinder. Retaining means connect the packing assembly to the rotary quill. The retaining means allow limited relative rotational movement of the packing assembly with respect to the rotary quill about the longitudinal axis of the kelly.

In the preferred embodiment, a drive bushing is located intermediate the rotary quill and the kelly and is engagable with the quill and kelly to transmit rotational force. A packing ring is spaced apart from the drive bushing within the cylinder and is carried about the kelly proximate an end thereof for sealing hydraulic fluid within the cylinder.

A cylindrical packing retainer surrounds the packing ring within the cylinder and has an inner circumferential lip for resisting axial movement of the packing ring within the cylinder. The packing retainer also has an outer circumferential lip at the opposite extent thereof.

A packing gland having a cylindrical body portion is adapted to contact the packing ring to bias the ring against the packing retainer inner lip. The packing gland also has an outer flange. The rotary quill has an outer extent having a series of circumferentially spaced threaded bores, each of the bores being adapted to receive a threaded end of a connecting bolt. The packing retainer outer lip and the placing gland outer flange are each provided with a series of apertures which are alignable with the rotary quill threaded bores.

The retaining means comprises a series of threaded bolts passing through the aligned apertures in the packing gland outer flange and the packing retainer outer lip and received within the rotary quill threaded bores. A series of spacer bushings contained within the packing retainer apertures have internal diameters sufficient to receive the threaded bolts and have external diameters less than the internal diameters of the packing retainer apertures. In this way, the retaining means allows limited relative rotational movement of the packing retainer and packing ring with respect to the rotary quill about the longitudinal axis of the kelly.

DETAILED DESCRIPTION OF THE INVENTION

Figure 2:
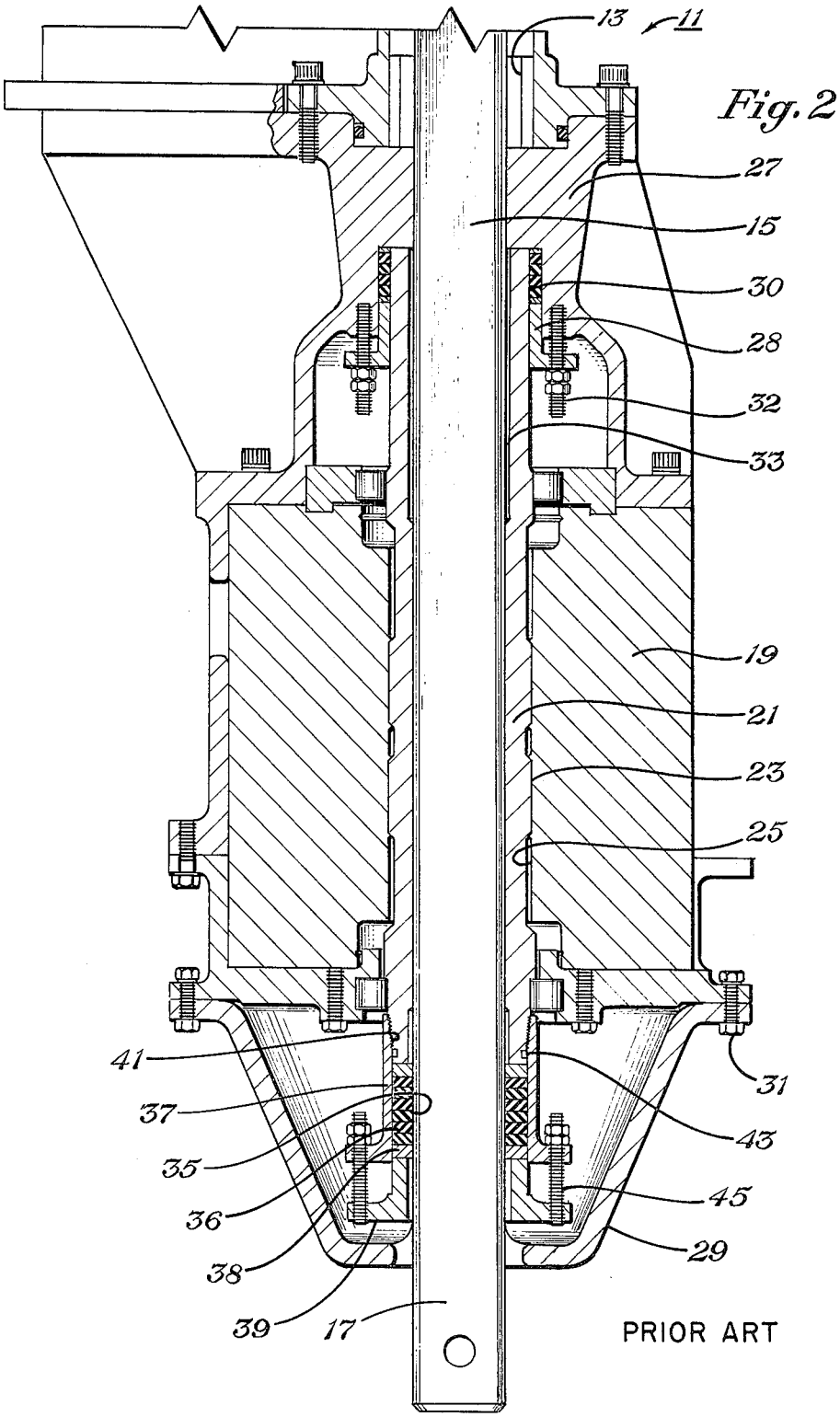
Fig. 2 PRIOR ART
FIG. 2 is a side partial cross-sectional view of a hydraulic digger showing a prior art kelly seal arrangement.

Turning first to FIG. 2, there is shown a prior art device which illustrates the problem toward which the present invention is directed. The hydraulic mast digger of FIG. 2 includes a hydraulic cylinder or mast, the lower end of which is shown designated generally as 11 in FIG. 2. The mast is normally mounted in a truck and includes an elevator mechanism for moving the mast to the vertical or working position shown in FIG. 2. The mast 11 includes a cylindrical inner bore 13 which may continue upward for twenty feet or more. A kelly 15 is carried inside the bore 13 of mast 11. The kelly 15 is a square bar or tube slightly longer than the mast 11. The free end 17 of the kelly is adapted to receive an auger or other suitable working tool.

The kelly 15 is rotatably driven by a hydraulic motor (not shown) through a rotating assembly 19 and an intermediate drive bushing 21. For instance, drive bushing 21 can have a square internal diameter adapted to slide over the kelly and outer splined surfaces 23 for engaging mating surfaces 25 of the rotating assembly 19. An upper body section 27 extends upwardly from the rotating assembly 19 and provides a base for the continuation of the mast structure. The lower end of the device can be covered by a cap 29 connected by bolts 31.

A slight annular space 33 exists between the drive bushing and kelly along the entire length of the drive bushing and communicates hydraulic fluid with the bore 13 of the mast 11. Hydraulic fluid is sealed at the upper end of the drive bushing 21 by a packing gland 28 aand packing ring 30. Packing ring 30 is made up of a series of stacked rings of fiber reinforced rubber covered at either end by metallic outer rings. The packing gland 28 is biased toward placing ring 30 by bolts 32 which compresses packing ring 30 and forms a seal with the drive bushing 21.

The hydraulic fluid is sealed at the lower end of the device by a packing assembly which includes a packing ring 35 a packing retainer 37 and packing gland 39. The packing ring 35 is made up of a series of fiber reinforced rubber rings 36 covered at either end by metallic outer rings 38. The packing ring 35 has a polygonal interior opening, in this case square, to mate with the kelly, and a generally cylindrical exterior. The packing retainer 37 is rigidly affixed as by threads 41 to the lower end of the drive bushing 21. An O-ring seal 43 seals the packing retainer to the drive bushing. The packing gland 39 is biased toward the packing ring 35 by a series of adjusting bolts 45 and compresses the packing ring 35 causing the ring to form a seal with the kelly 15. The drive bushing, packing retainer, packing ring, and packing gland all rotate with the kelly as torque is applied to the drive bushing by the rotating assembly 19. Ideally, the packing 35 is completely isolated from the torque which is transmitted from the drive bushing 21 to the kelly 15 and serves only to seal the lower end of the hydraulic cylinder or chamber formed by the annular space 33 and bore 13.

In practice, however, the drive bushing interior surfaces eventually become worn from contacting the exterior of the kelly. As more play or "slop" develops between the drive bushing and kelly, the packing 35 tends to be the first point of contact with the kelly 15 which causes the packing 35 to tend to drive the kelly 15. The packing ring square internal opening is deformed by the load and assumes a more rounded appearance, thereby resulting in loss of the fluid seal with resultant fluid leakage.

Figure 1:
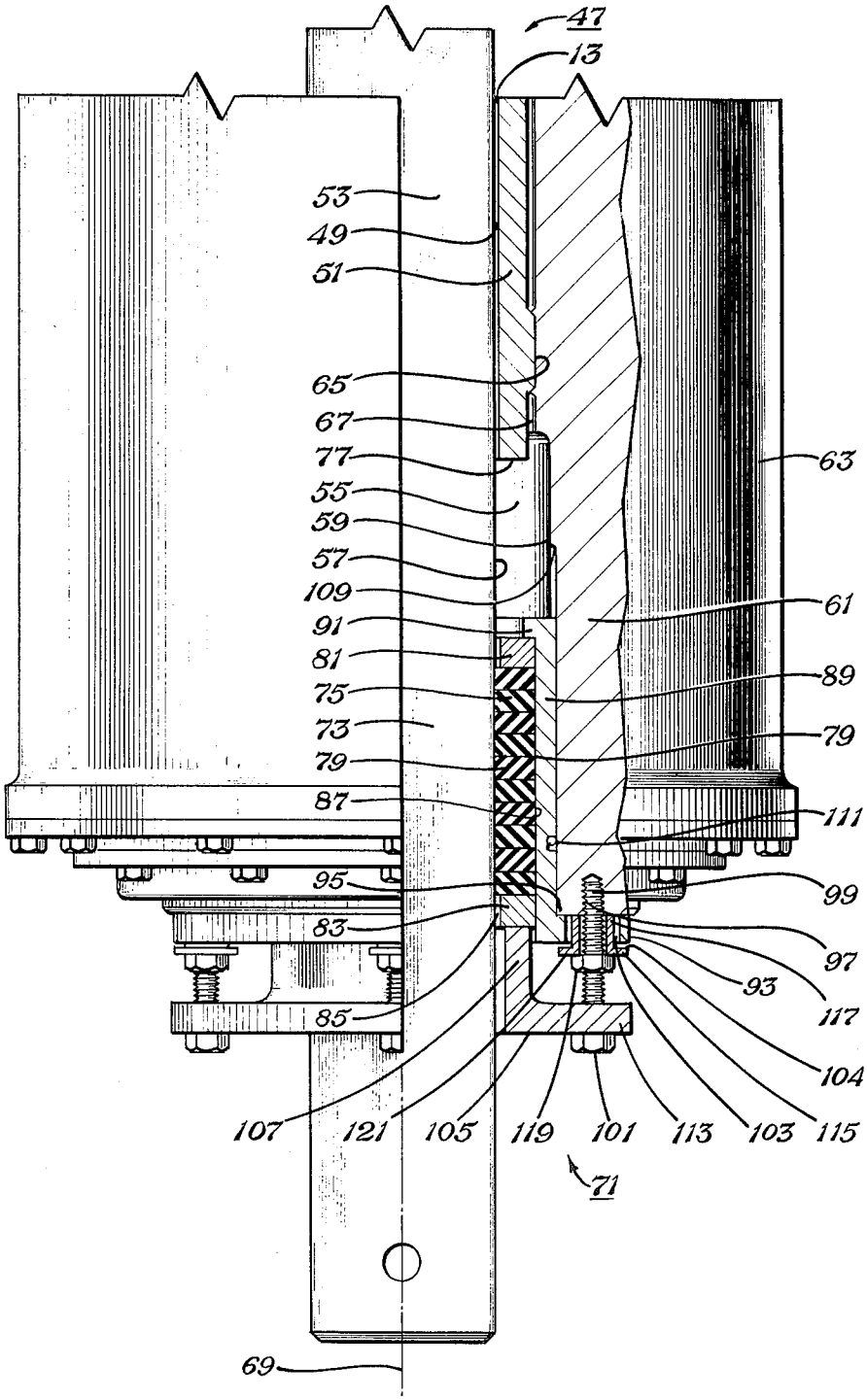
FIG. 1 is a side partial cross-sectional view of the lower end of a hydraulic digger showing the kelly seal of the invention.

Turning to FIG. 1, there is shown an improved kelly seal for a hydraulic mast digger which is the subject of the present invention. The digger once again includes a hydraulic cylinder or mast, the lower end of which is shown in FIG. 1, designated generally as 47. The mast 47 includes a cylindrical inner bore 13, as previously described, which continuously communicates with an annular space 49 between the drive bushing 51 and kelly 53 and with an opening 55 formed between the kelly exterior surface 57 and the internal diameter 59 of a surrounding rotary quill 61. The mast bore 13, annular space 49, and opening 55 together form a hydraulic cylinder in which the kelly 53 is axially movable by the application of hydraulic fluid pressure to the kelly head or piston located in the top region of the mast (not shown) in the conventional manner. For example, a suitable kelly head or piston is shown in U.S. Pat. No. 4,261,251 to Shepherd, issued Apr. 14, 1981, entitled "KELLY HEAD FOR HYDRAULIC MAST DIGGER".

Rotary quill 61 is a cylindrically shaped member which forms a part of the rotary assembly 63 which serves to impart torque to the drive bushing 51, which, in turn, drive the kelly 53. The drive bushing 51 has a polygonal, in this case square, interior to engage the square kelly 53 and has suitable exterior surfaces 65 for matingly engaging the internal diameter 67 of the rotary quill 61. A gear drive (not shown) imparts rotary torque to the rotary quill 61. The rotary quill 61 imparts rotary force or torque to the intermediate drive bushing 51 and from the drive bushing 51 to the kelly 53. The rotary quill, drive bushing 51, and kelly 53 all rotate together as a unit and at the same speed. The kelly 53 is rotatably carried within the mast cylinder 47 and is axially movable with respect to the longitudinal axis 69 of the cylinder.

A packing assembly, designated generally as 71, is carried about the kelly 53 lower end 73 within the hydraulic cylinder 47 proximate the lower end thereof for sealing hydraulic fluid within the hydraulic cylinder 47. The packing assembly 71 is made up of a series of stacked packing rings 75 which are spaced-apart from the lower end 77 of drive bushing 51 within cylinder 47 and are carried about kelly 53 proximate end 73 for sealing hydraulic fluid within cylinder 47. The packing assembly 71 can include a series of intermediate rings 79 made of fiber-reinforced rubber material and top and bottom outer rings 81, 83 of metal, preferably bronze. The interior opening 85 in the rings 79, 81, 83 is polygonal, preferably square, to accommodate the square kelly 53. The exterior 87 of the packing assembly 71 is generally cylindrical.

A cylindrical packing retainer 89 surrounds the packing rings 75 within a cylinder 47. Packing retainer 89 has an inner circumferential lip 91 which receives the outer metallic ring 81 of packing assembly 71 and resists axial movement of packing rings 75 within cylinder 47 in the direction of drive bushing lower end 77. Inner circumferential lip 91 is spaced apart from a shoulder 109 in rotary quill internal diameter 59. Packing retainer 89 also has a circumferential outer lip 93 opposite lip 91.

As shown in FIG. 1, quill 61 has an outer extent 95 having a series of circumferentially spaced threaded bores 97 which are equidistantly spaced from the internal opening 59 of the quill 61. Each of the bores 97 is adapted to receive the threaded end 99 of a connecting bolt 101. Outer lip 93 of packing retainer 89 overlies the outer extent 95 of rotary quill 61 and is provided with a series of apertures 103 which are alignable with bores 97.

A packing gland 105 having a cylindrical body portion 107 is adapted to contact the lower packing ring 83 to bias the ring 83 against the packing retainer inner lip 91. Packing gland 105 also has an outer circumferential flange 113.

The packing gland outer flange 113 is provided with a series of apertures which are alignable with the rotary quill threaded bores 97 and the apertures 103 in lip 93 of packing retainer 89. In order to bias packing ring 75, a series of threaded bolts 101 are inserted through the apertures in flange 113, through apertures 103 in lip 93 and engaged in the threaded bores 97 in rotary quill outer extent 95. Threaded bolts can also be inserted at locations intermediate bolts 101 which pass through the apertures 103 in lip 93 and are engaged in threaded bores 97 in rotary quill outer extent 95 but which do not pass through the apertures in flange 113 in order to further engage the packing retainer 89.

The biasing force of packing gland 105 causes packing ring 75 to be compressed radially to contact kelly 53 and form a fluid seal with the exterior surface of kelly lower end 73. An O-ring 111 is placed in a groove in the exterior surface of packing retainer 89 to sealingly engage the rotary quill internal diameter and complete the seal assembly.

A series of spacer bushings 115 are contained within the packing retainer apertures 103. Bushings 115 each have a cylindrical body 117 with an internal diameter sufficient to receive threaded bolts 101 and an external diameter less than the internal diameter of the packing retainer apertures 103. The length of the cylindrical body portions 117 of bushings 115 is such that a clearance 104 results between the outer lips 121 of the bushings and lip 93 in packing retainer 89. By providing a clearance between the bushing body portions 117 and the packing retainer apertures 103 and between the bushing lips 121 and lip 93 in packing the retainer 89, the spacer bushings 115 allow limited relative rotational movement of the packing retainer 89 and packing ring 75 with respect to the rotary quill 61 about the longitudinal axis 69 of the kelly 53. Each of the spacer bushings 115 is retained within its respective packing retainer aperture 103 by an adjustable nut 119 carried on the threaded bolt 101 received within the respective aperture 103. The nut 119 is adjusted upwardly to contact the outer lip 121 on the bushing 115.

The threaded bolts 101, nuts 119, and spacer bushings 115 comprise retaining means connecting packing gland outer flange 113 and packing retainer outer lip 93 and connecting the packing retainer lip 93 to the rotary quill 61. The retaining means non-rigidly affixes the packing assembly 71 to the quill 61 and thus allows limited relative rotational movement of the packing retainer 89 and packing ring 75 with respect to the rotary quill 61 about the longitudinal axis 69 of the kelly 53.

In operation, the packing retainer 89 is engaged within the cylinder 47 with packing rings 75 being contained by the inner lip 91 of retainer 89. The packing gland body portion 107 is placed over the kelly into contact with the lower metallic ring 83 of packing ring 75. The threaded bolts 101 are then placed in the apertures provided in flange 113, nuts 119 are threaded part way up the bolts, and the threaded ends 99 are inserted through the aligned openings in the spacer bushings 115 apertures 103 and engaged in threaded bores 97. The nuts 119 on bolts 101 are selectively positioned along the threaded lengths of the bolts 101 to contact the bushing outer lips 121 and thereby retain the bushings within the respective apertures 103. Although the numbers of threaded bolts used can vary depending upon the particular application, eight bolts are utilized in the preferred embodiment and are symetrically spaced about the interior opening 85 of the cylinder. Four bolts pass through both outer flange 105 and lip 93 and four intermediate bolts pass only through lip 93.

The improved kelly seal has significant advantages. Because of the limited relative rotational movement provided by the retaining means of the packing assembly 71, any tendency of the packing assembly 71 to transmit torque and thereby drive the kelly 53 is reduced or eliminated. The packing assembly 71 is isolated from the drive torque which is transmitted from the gear drive, through the rotary quill to the drive bushing, and through the drive bushing to the kelly. Because the packing ring 75 is not deformed and subjected to heavy torque loads, the life expectancy and effectiveness of the kelly seal are improved.

While the invention has been shown in only one of its forms, it is not thus limited but is susceptible to various changes and modifications within the scope of the invention.

We claim:

1. An earth boring machine, comprising:

a hydraulic cylinder;

a kelly rotatably carried within said cylinder and axially movable with respect to the longitudinal axis of said cylinder;

a rotary quill surrounding said kelly for supplying rotational force to said kelly;

a packing assembly carried about said kelly within said hydraulic cylinder proximate an end thereof for sealing hydraulic fluid within said hydraulic cylinder; and retaining means for connecting said packing assembly and said rotary quill, said retaining means allowing limited relative rotational movement of said packing assembly with respect to said rotary quill about the longitudinal axis of said kelly.

2. An earth boring machine, comprising:

a hydraulic cylinder;

a kelly rotatably carried within said cylinder and axially movable with respect to the longitudinal axis of said cylinder;

a rotary quill surrounding said kelly for supplying rotational force to said kelly;

a drive bushing intermediate said rotary quill and said kelly and engagable with said quill and kelly to transmit rotational force;

a packing assembly carried about said kelly within said hydraulic cylinder proximate an end thereof for sealing hydraulic fluid within said hydraulic cylinder; and retaining means for non-rigidly affixing said packing assembly and said rotary quill, said retaining means allowing limited relative rotational movement of said packing assembly with respect to said rotary quill about the longitudinal axis of said kelly.

3. An earth boring machine, comprising:

a hydraulic cylinder;

a kelly rotatably carried within said cylinder and axially movable with respect to said cylinder;

a rotary quill surrounding said kelly for supplying rotational force to said kelly;

a drive bushing intermediate said rotary quill and said kelly and engagable with said quill and kelly to transmit rotational force;

a packing ring spaced apart from said drive bushing within said cylinder and carried about said kelly proximate and end thereof for sealing hydraulic fluid within said cylinder;

a packing retainer surrounding said packing ring within said cylinder;

a packing gland having a body portion adapted to contact said packing ring to bias said ring against said packing retainer; and retaining means for connecting said packing gland and said packing retainer and connecting said packing retainer to said rotary quill, said retaining means allowing limited relative rotational movement of said packing retainer and packing ring with respect to said rotary quill about the longitudinal axis of said kelly.

4. An earth boring machine, comprising:

a hydraulic cylinder;

a kelly rotatably carried within said cylinder and axially movable with respect to said cylinder;

a rotary quill surrounding said kelly for supplying rotational force to said kelly;

a drive bushing intermediate said rotary quill and said kelly and engagable with said quill and kelly to transmit rotational force;

a packing ring spaced apart from said drive bushing within said cylinder and carried about said kelly proximate and end thereof for sealing hydraulic fluid within said cylinder;

a cylindrical packing retainer surrounding said packing ring within said cylinder and having an inner circumferential lip for resisting axial movement of said packing ring within said cylinder and having an outer circumferential lip at the opposite extent thereof;

a packing gland having a cylindrical body portion adapted to contact said packing ring to bias said ring against said packing retainer inner lip said packing gland having an outer flange; and retaining means for connecting said packing gland outer flange and said packing retainer outer lip and connecting said packing retainer lip to said rotary quill, said retaining means allowing limited relative rotational movement of said packing retainer and packing ring with respect to said rotary quill about the longitudinal axis of said kelly.

5. The earth boring machine of claim 4, wherein said rotary quill has an outer extent having a series of circumferentially spaced threaded bores, each of said bores being adapted to receive a threaded end of a connecting bolt, and wherein said packing retainer outer lip and said packing gland outer flange are each provided with a series of apertures which are alignable with said rotary quill threaded bores.

6. The earth boring machine of claim 5, wherein said retaining means comprises a series of threaded bolts passing through said aligned apertues in said packing gland outer flange and said packing retainer outer lip and received within said rotary quill threaded bores, said retaining means further comprising a series of spacer bushings contained within said packing retainer apertures, said spacer bushings having an internal diameter sufficient to receive said threaded bolts and having an external diameter less than the internal diameter of said packing retainer apertures, whereby said retaining means allows limited relative rotational movement of said packing retainer and packing ring with respect to said rotary quill about the longitudinal axis of said kelly.

7. The earth boring machine of claim 6, wherein each of said spacer bushings is retained within its respective packing retainer aperture by an adjustable nut carried on the threaded bolt received within said aperture.

8. In an earth boring machine of the type having a hydraulic cylinder, a kelly rotatably carried within said cylinder and axially movable with respect to the longitudinal axis of said cylinder, a rotary quill within said cylinder for supplying rotational force to said kelly, and a drive bushing intermediate said rotary quill and said kelly and engagable with said quill and kelly to transmit rotational force, the improvement comprising:

a packing assembly carried about said kelly within said hydraulic cylinder proximate an end thereof for sealing hydraulic fluid within said hydraulic cylinder; and retaining means for non-rigidly affixing said packing assembly to said rotary quill, said retaining means allowing limited relative rotational movement of said packing assembly with respect to said rotary quill about the longitudinal axis of said kelly.

* * * * *